United States Patent [19]

Hungerford

[11] 4,151,668

[45] May 1, 1979

[54] INDIVIDUAL WELL-BALANCED MEAL PLANNING DEVICE

[76] Inventor: Daniel C. Hungerford, 11651 Lake House Ct., Lost Tree Village, North Palm Beach, Fla. 33403

[21] Appl. No.: 627,070

[22] Filed: Oct. 30, 1975

[51] Int. Cl.[2] ..... G06C 3/00; G09F 11/04

[52] U.S. Cl. ..... 40/495

[58] Field of Search ..... 116/133; 128/1 R; 235/78, 88; 40/70 R; 35/31 C, 74

[56] References Cited

U.S. PATENT DOCUMENTS

| | | | |
|---|---|---|---|
| 1,323,763 | 12/1919 | Haskell | 40/70 R |
| 2,188,744 | 1/1940 | Turner | 40/67 |
| 2,681,523 | 6/1954 | Sellers | 40/70 R |
| 2,956,358 | 10/1960 | Pennington | 40/70 R |

*Primary Examiner*—Edith S. Jackmon

*Attorney, Agent, or Firm*—Malin & Haley

[57] ABSTRACT

A calculator for use by an individual on a strict diet such as a diabetic to expedite food item selection for a complete single meal in accordance with a predetermined calorie, carbohydrate, protein and fat diet plan. The device includes a plurality of smaller diameter circular discs having viewing apertures rotatably affixed to a larger disc which cooperate for rapid selective registration of complete daily meals from a plurality of entrees or primary foods, the device including daily meal plans for breakfast, lunch and dinner. The device, through movement of the discs, also allows for individual food item exchange per meal in accordance with a particular dietetic plan to allow the individual a variety in the selection of food items to be consumed.

14 Claims, 6 Drawing Figures

INDIVIDUAL WELL-BALANCED MEAL PLANNING DEVICE

BACKGROUND OF THE INVENTION

This invention relates generally to a device which aids a person who must maintain a strict calorie, carbohydrate, protein and fat diet to quickly and rapidly ascertain a combination of individual food items which when taken together provide a well-balanced meal in accordance with the dietetic plan that has been predetermined for a particular person.

In recent years, medical science has come to realize the importance of a well-balanced diet for the good health and longevity of an individual, including proper calorie control and regulated consumption of carbohydrates, proteins and fats consumed in accordance with a balanced daily meal plan. Many other groups of individuals such as diabetics must adher to a strict daily calorie, carbohydrate, protein and fat diet. In fact, the single most effective manner for treating diabetes is through the daily control of carbohydrates, proteins, fats and calories.

Volumes and volumes of literature have been put forth in recent years by a multitude of different authors and experts with regard to food nutrition, dietetic requirements and, in general, all aspects of proper well-balanced meal considerations. Most of the information, because of its prolixity and lack of organization, remains totally unusable by the layman for effective daily meal planning and individual food item selection. Many of the diet plans suggested by experts is monotonous and unappealing to the dieter. The instant invention provides a device which allows for accurate and rapid selection of a complete dietetically balanced meal in accordance with a predetermined dietetic daily meal plan, the individual food items being correlated together in an easy-to-read display while still allowing the individual to select a variety of foods. The instant invention provides for a plurality of displayed complete meals radially columnized under a variety of entrees of main courses coordinated for breakfast, lunch and dinner and includes a list from broad food categories of particular exchangeable individual foods which may be consumed to form each balanced meal.

BRIEF DESCRIPTION OF THE INVENTION

A hand-held calculator providing a plurality of complete individual meals for breakfast, lunch and dinner which are correlated in accordance with particular daily calorie, carbohydrate, protein and fat intake limits, while at the same time allowing for maximum selectability of particular food items for daily meal variety. The device includes a large diameter centered disc and at least one or more smaller diameter discs moveably attached thereto, the large disc having indicia columns headed by entree displaying a plurality of breakfast, lunch and dinner meal plans, the breakfast, lunch and dinners displayed being consumable in any daily combination to achieve a particular daily dietetic plan such as maximum calories per day. The smaller diameter disc or discs include viewing apertures which are utilized in combination with registration indicia for relative movement of the discs by an individual for particular meal selection with the entree headings. Indicia adjacent the outer periphery of the larger disc displays a number of entrees or primary food items considered as the main course of the meal. For example, on one side of the large disc, adjacent the peripheral edge is displayed a list of entrees or main course food items which may be selected for breakfast or lunch such as poached egg on toast, scrambled eggs, egg omelete, cereals, waffles, or fish. Once determining the primary food item, the individual rotates the smaller disc alignment indicia to the selected entree, which aligns the smaller disc viewing aperture to the correct column. For example, if "poached egg on toast" is selected, the smaller diameter disc is aligned with indicia adjacent the "poached egg on toast" breakfast column. Observable through the viewing aperture of the smaller diameter disc is a complete list of individual food items for a well balanced breakfast including toast, skim milk, juice and butter in the proper proportions so that the individual maintains the pre-planned dietetic consumption plan. The smaller disc or discs include indicia of the broad food category and the number of food units allowed for each category of foods, such as vegetables, bread, milk, meat, fruits and fat. However, the individual may deviate from the complete meal plan presented by a food exchange within a broad food category. Exchangeable food items are displayed by broad food categories in circular rows. For a food exchange from a particular category of foods, the individual rotates the smaller outer disc to any other column which displays in the same circular row a dietetic equivalent but different individual food item which can be substituted in the selected meal plan.

Also displayed on the larger disc are a plurality of different lunches arranged in columns headed by primary food items representing a particular main course such as a hamburger, hot dog, etc. Just as for breakfast selection, the smaller disc is rotated aligning the indicia such that the smaller disc viewing aperture displays a complete list of food items to be consumed along with the primary food item selected for a well-balanced meal. Again, the individual may vary the presented meal plan by exchanging items within a single circular row by rotating the viewing aperture of the smaller disc to another column.

In one embodiment having smaller discs on each side of the larger disc, breakfast and lunch selections are displayed on one side and dinner selections on side two. For dinner selection, the device is turned over, displaying side two which likewise includes a smaller disc rotatably affixed to the larger disc. The larger disc displays about its periphery a plurality of entrees in a columnized array that constitute dinner main courses. The primary food item indicia, for example, includes a plurality of main courses such as beef roast, meat loaf, lamb, pork, foul or shrimp or fish. For the particular dinner plan, the individual first would select the particular main course desired. For example, the dinner disc may be aligned by arrows adjacent "beef, rib roast." In the viewing aperture of the smaller disc, a complete column radially disposed on the larger disc is then viewable which includes by volume individual food items forming a total balanced meal that may be consumed in accordance with the particular dietetic meal plan. A broad food category listing is displayed on the smaller disc adjacent the observation aperture for broad categories of foods such as vegetables, bread, meat, milk, fruits and fat. Each food category indexes circular rows concentrically displayed on the large disc. The columnized lists include type and volume of specific food items to be eaten with the main course or primary food item. Should the individual desire exchanging any particular food item in a particular broad food category, he would merely rotate the smaller disc to display any other column until he finds a substitute from the same circular row which has been predetermined by volume as a dietetic equivalent. This allows for maximum food item selectability while maintaining a strict diet. Each device is constructed according to a particular daily plan such as by using a specific number of calories or carbohydrates per day allowed.

Thus, utilizing as in one embodiment both sides of the instant invention, an individual has readily presented by entree a plurality of individual food items constituting complete meals for coordinating breakfast, lunch and dinner including lists of food items which have been coordinated in accordance with a particular dietetic plan while still allowing, through circular rows of different food items correlation of broad food categories of vegetables, bread, meats, milk, fruits and fats selective exchange of individual food items for maximum variety.

It is an object of this invention to provide a concise, coordinated calculating device which allows an individual to rapidly and efficiently select at a glance an entire meal including all the necessary food items and their proper volumes to achieve a well-balanced meal in accordance with a predetermined dietetic plan.

It is another object of this invention to provide a small hand-held pocket or purse sized device for an individual to readily ascertain at a glance a complete selection of individual food items for a balanced meal.

But yet still another object of this invention is to provide a calculating disc which allows for rapid meal planning for individual food items in accordance with a well-balanced meal plan while still allowing for selectability by providing food exchange by volume and item for increased meal variety.

And yet still another object of this invention is to provide a device which allows an individual who must adher to a strict calorie, carbohydrate, protein and fat diet to maintain at his fingertips an entire meal plan for all three meals-breakfast, lunch and dinner—which have been coordinated and correlated to a specific dietetic plan.

In accordance with these and other objects which will be apparent hereinafter, the instant invention will now be described with particular reference to the accompanying drawings.

PREFERRED EMBODIMENT OF THE INVENTION

Figure 3:
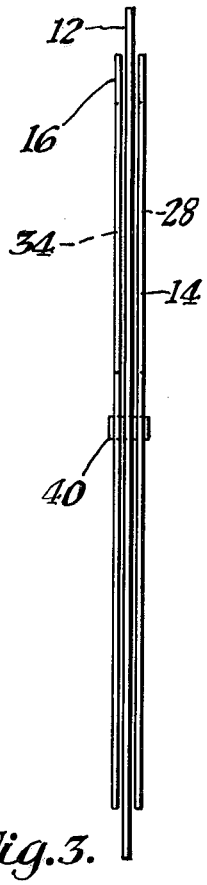
FIG. 3 shows a side elevational view of the instant invention.

Referring now to the drawings and especially FIG. 3, the instant invention is shown comprised of a plurality of indicia bearing discs including a larger diameter inner disc 12 connected at its center to a pair of smaller diameter discs 14 and 16 which are rotatably coupled to the larger disc by a grommet 40. The discs 14 and 16 have observation apertures 28 and 34 respectively.

Figure 1:
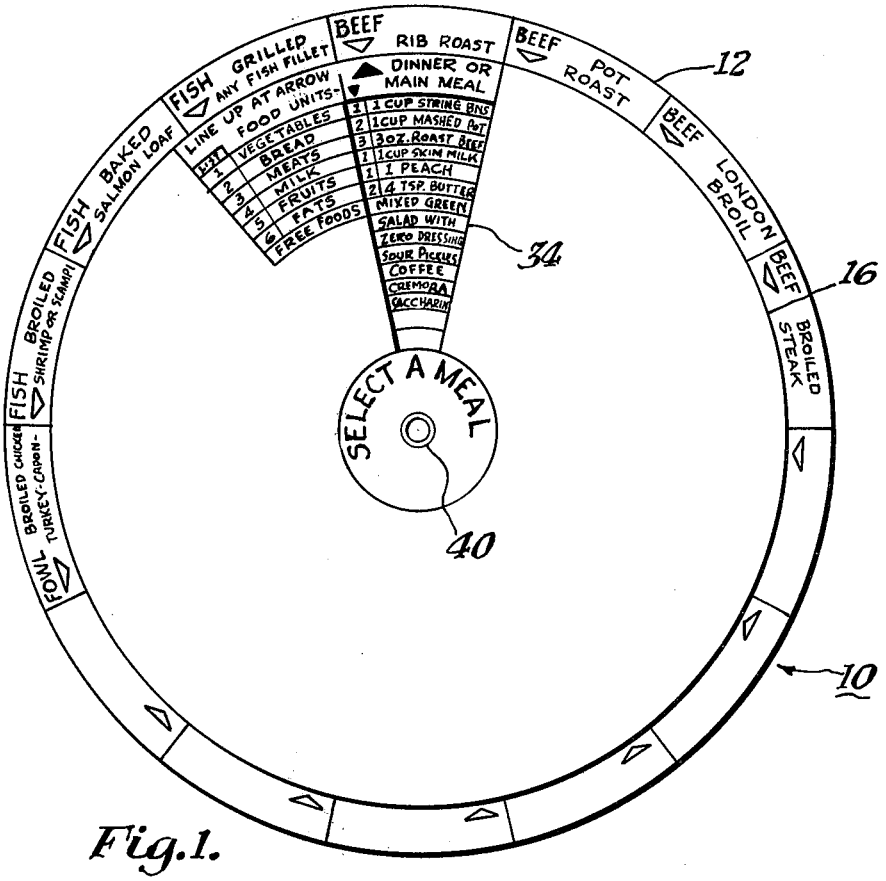
FIG. 1 shows a front elevational view (side one) of the instant invention.
Figure 4:
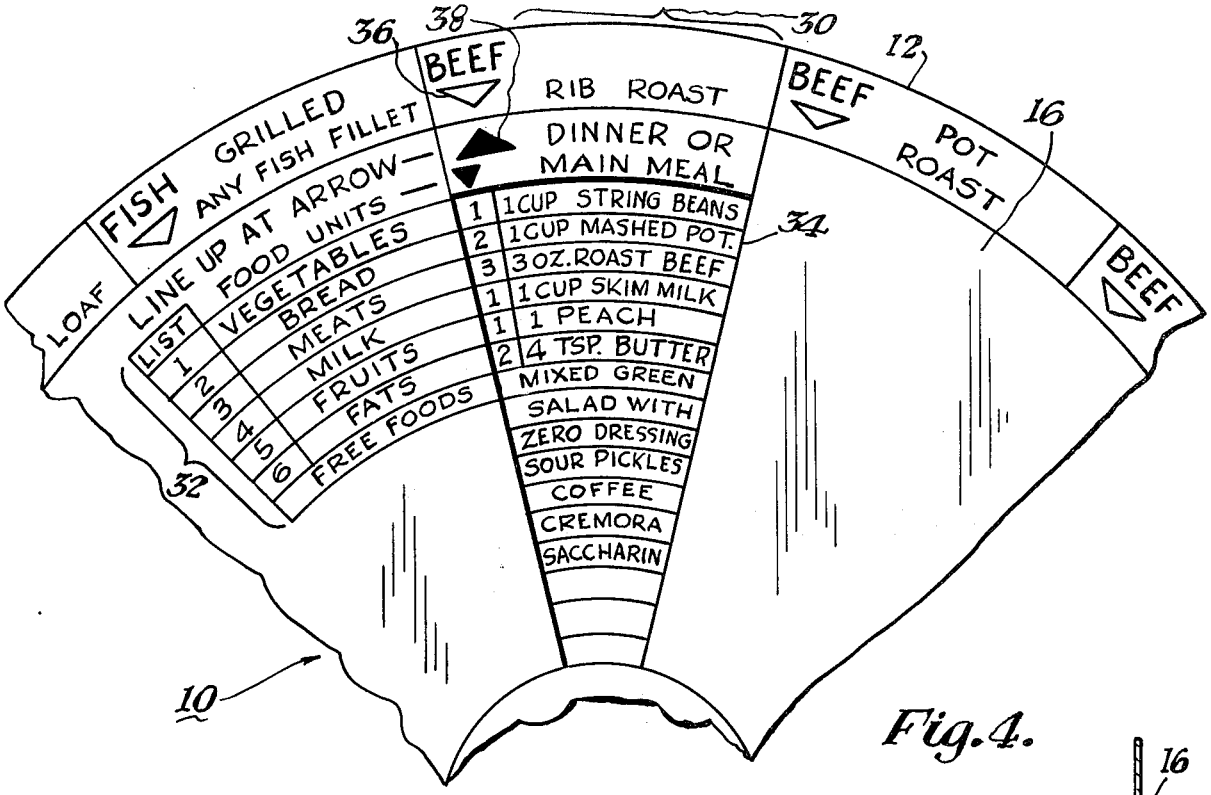
FIG. 4 shows a fragmentary, front elevational view (side one) of a portion of the invention.

Referring now to FIGS. 1 and 4, the device 10 provides for dinner selection, having disposed around the outer peripheral edge of disc 12 a plurality of radial indicia columns, such as 30, with the heading of the column in the observable portion being a specific entree or main course food item such a beef, pork, foul, or fish, allowing the dieter to select from a plurality of commonly known main courses in order to determine the specific meal. Once the main course food item has been selected, such as "beef rib roast," the smaller disc 16 is aligned at arrow 38 with the larger disc 12 at arrow 36, which then provides through viewing aperture 34 of disc 16, a complete well-balanced dinner including a vegetable, bread, milk, fruits and fat and the specific volume of each that may be consumed. Displayed on the smaller disc 16 along one side of aperture 34 is a radial column of food categories, including vegetables, bread, meats, milk, fruits and fats which are aligned with the circular rows of specific food items displayed on disc 12. The food items listed in each circular row are dietetic equivalents of each other that may be exchanged. In the example shown under the main meal for a beef rib roast, the dieter could select one cup of mashed potatoes for the bread food category. However, should the dieter wish to exchange food items, he may select any of the bread items in the same circular row by rotating the smaller disc aperture to any other entree column.

Figure 2:
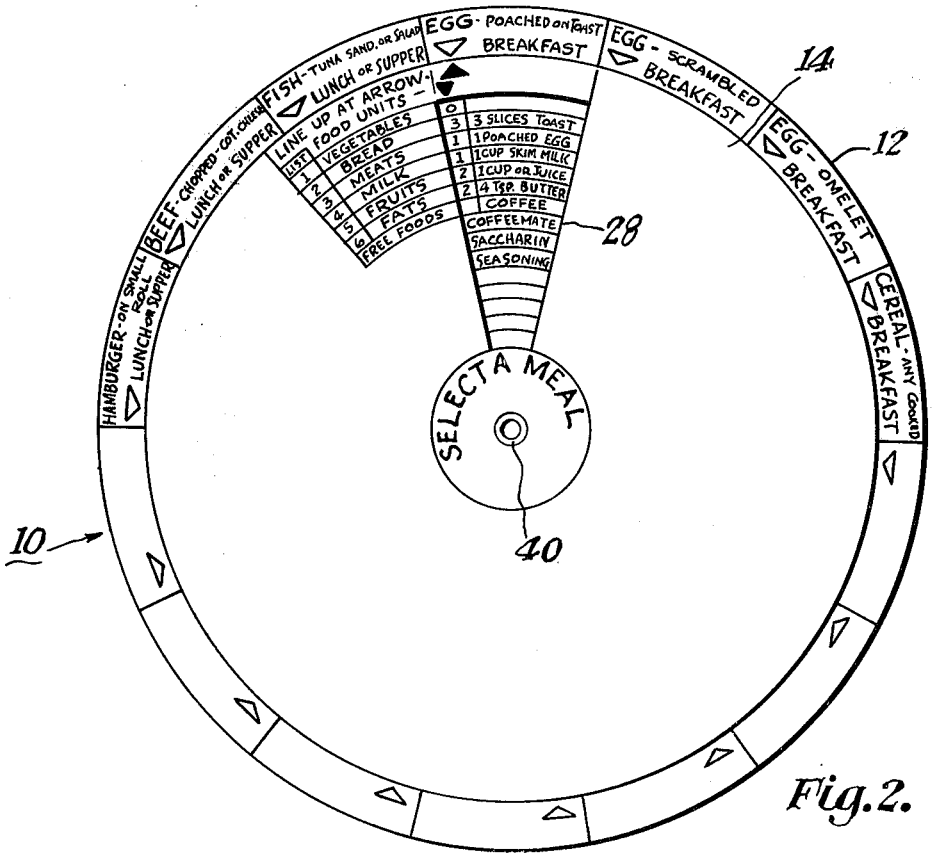
FIG. 2 shows a back elevational view (side two) of the instant invention.
Figure 5:
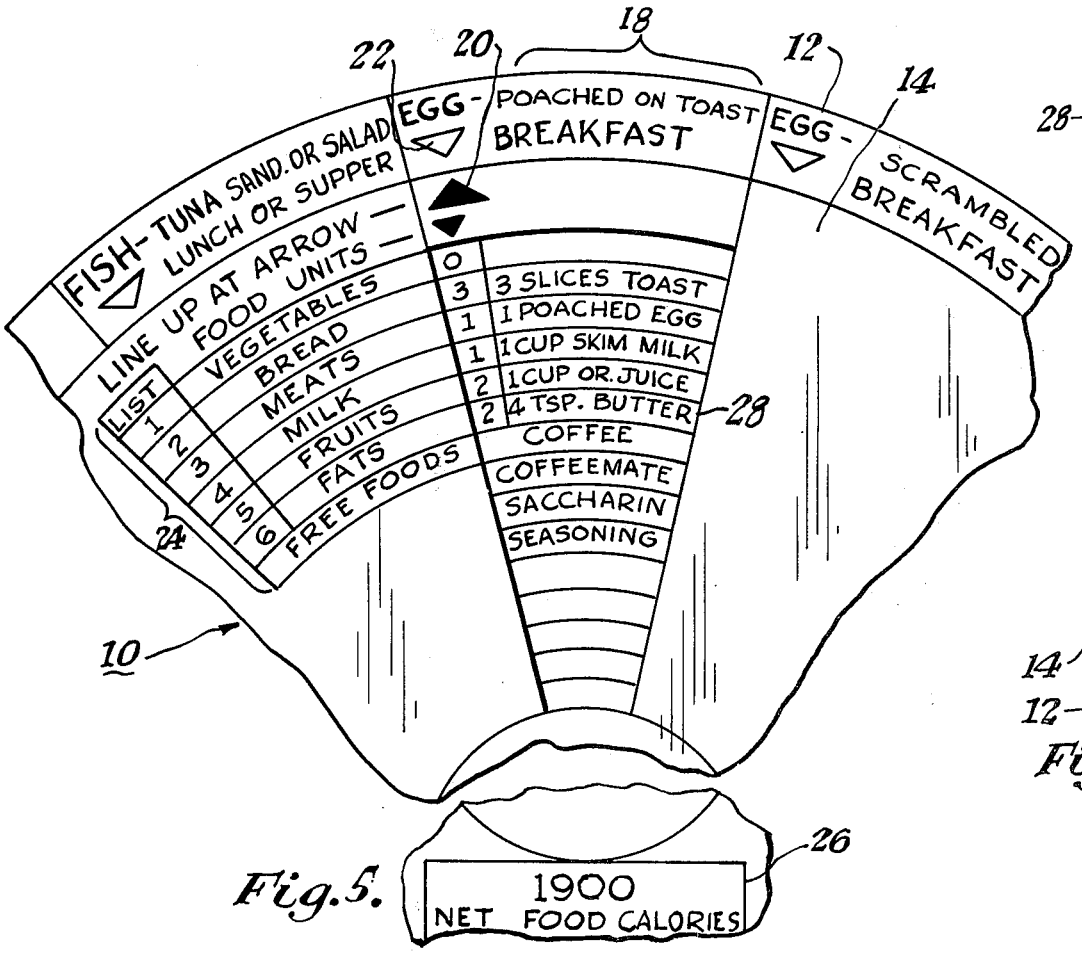
FIG. 5 shows a fragmentary, back elevational view (side two) of a portion of the invention.
Figure 6:
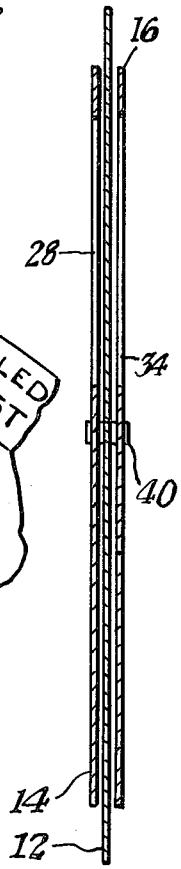
FIG. 6 shows a side elevational view partially in cross-section of the instant invention.

Referring now to FIG. 2 and FIG. 5, side two of the device is shown having a plurality of entrees or main course food items arranged around the periphery of disc 12. In each primary food column, e.g., column 18, a specific breakfast or lunch such as an "egg-poached on toast" is displayed. Each disc has arrows 20 and 22 for aligning smaller disc 14 with the larger disc 12 so that viewing aperture 28 of disc 14 exposes a single individual radial column such as column 18. Displayed on disc 14 along the vertical side of the viewing aperture 28 is a column of broad food categories (shown as column 24), listing the vegetables, bread, meats, milk, fruits and fat which are alignable with the specific foods listed in column 18, showing a complete well balanced breakfast including specific food items for each respective food category and the amount of the food item which may be consumed in accordance with the plan presented. On side two, a plurality of complete breakfasts and lunches are presented by main course which allows the individual to quickly and easily select a main course and by rotating disc 14 obtain a list of specific food items for the complete well-balanced meal. Instantly, after the discs have been aligned, a complete list is displayed in aperture 28. Each of the concentric circular rows of indicia shown adjacent column 24 (which shows a broad category of foods) on disc 12 displays exchangeable foods from the same category which may be substituted for any particular food item shown in the initially selected entree column. For example, FIG. 2 shows that upon selection of the "poached egg on toast" breakfast, the individual may have one cup of orange juice. However, if the individual does not wish to have orange juice he may merely rotate disc 14 to another entree column and select a particular fruit within the same circular row. Each substitute item is chosen to be a dietetic equivalent.

The foods and quantity values displayed on each device are determined for a particular individual such as a diabetic in accordance with a net food calorie per day diet, which in the example shown is 1900 calories. Thus utilizing side two of the device, a plurality of different breakfasts and different lunches arranged by main courses is presented in which any breakfast displayed may be consumed with any lunch displayed while maintaining an overall calorie intake limit. The overall meal scheme for breakfast, lunch and dinner are all coordinated so that the dieter may select any breakfast in combination with any lunch shown on side one of the calculator in conjunction with any dinner on side two of the calculator.

Instead of the breakfasts and lunches being displayed on one side and dinners on the other side, the device may be constructed with breakfasts, lunches, and dinners listed together on both sides, or with separate devices having only breakfasts, lunches or dinners.

The individual column displays of food items includes a column showing the number of food units of each food item displayed for equating foods and volumes in accordance with a standardized unit value system.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A calculator for determining a particular well-balanced meal from a plurality of well-balanced meals in accordance with a daily diet quantitative plan which includes providing breakfast, lunch and dinner comprising:

a first larger diameter disc, said larger disc having columnized indicia displayed thereon which includes outer perimeter prime headings having a plurality of entrees and a plurality of indicia columns disposed under said entrees headings which include indicia listing particular individual food items and their volume in accordance with an overall dietetic plan; and a second smaller disc moveably affixed to one side of said larger disc, said smaller disc having a viewing aperture and having next to said aperture an indicia list of broad food categories including vegetables, bread, meats, milk, fruits and fats disposed for alignment with individual food items in each of said columns on said larger disc.

2. A calculator, as in claim 1, wherein said larger disc includes:

a pluralit of concentric circular rows, each of said rows displaying different food items from a common food category which are dietetically determined equivalents.

3. A meal selecting device which selectively displays a pre-determined array of individual food items comprising a dietetically, well-balanced, daily meal in accordance with a pre-determined daily caloric intake comprising:

a display surface having indicia showing a plurality of complete well-balanced dietetical meals displayed therein, said indicia including entree headings disposed around the perimeter of said surface and each of said meals displayed having individual food items from different food categories and displayed beneath a different entree heading; and indicia means for selecting a particular complete meal by entree heading disposed on said display surface.

4. The device as in claim 3, wherein:

the plurality of meals displayed include the volume of food permitted to achieve an overall particular daily calorie intake.

5. The device as in claim 3, including:

means for selecting individual equivalent food items connected to said display surface.

6. A food organizer for selectively displaying a plurality of food items into a calorically balanced individual meal plan comprising:

meal indicia display means; indicia display showing a plurality of different meals made up of individual foods from different food categories determined in accordance with a pre-determined dietetic consumption plan disposed on said meal indicia display means, said indicia display including entree headings disposed around the periphery of said meal indicia display means; and means for selectively displaying a single meal connected to said meal indicia display means.

7. The device as in claim 6 including:

means connected to said meal display means for selectively exchanging particular food items in a particular meal to determine an equivalent different food item with the same caloric value.

8. A device as in claim 7, including:

means for selectively registering a particular, predetermined meal on said meal display means by utilizing said entree heading indicia display.

9. A hand-held menu for diabetics for quickly and accurately providing a plurality of pre-determined food items by quantity in accordance with a pre-determined caloric and carbohydrate daily intake plan for selecting a complete meal comprising:

a surface having indicia showing a plurality of radial columns, each column displaying a complete well-balanced meal constituting individual food items from different food categories by volume, each column having a primary food heading; and means connected to said surface for selecting a particular well-balanced individual meal from a particular primary food heading in accordance with the pre-determined calorie and carbohydrate food plan, whereby a diabetic individual may accurately and quickly select a complete, well-balanced food plan showing the proper proportions to achieve a particular daily calorie and carbohydrate intake.

10. A selective menu as in claim 9, including:

means for interchanging particular food items by volume for a particular meal with respect to said particular caloric plan provided.

11. A device for selectively displaying a plurality of individual food items from different food categories together into a balanced, dietetically determined meal comprising:

a display means having a plurality of meals displayed, each of said meals having an entree indicia heading disposed near said display means peripheral heading, each meal being an array of individual food items from different food categories to form a single meal of a pre-determined caloric and carbohydrate intake by volume of food items; and means for selecting a particular individual meal from said entree indicia heading connected to said display means.

12. A food planner, as in claim 11, including:

means for selectively interchanging particular equivalent food items having the same dietetic, caloric and carbohydrate equivalence connected to said display means.

13. The device as in claim 11, wherein:

said display means includes indicia showing a plurality of different entrees; and means for selecting a particular, individual, complete meal by selective registration with a particular entree from said plurality of displayed entrees.

14. A device for selecting a complete meal having a well-balanced plurality of different food items from different food categories by volume selected for achieving a particular, daily, caloric intake and daily carbohydrate intake comprising:

a first display means having indicia showing a plurality of primary foods disposed thereon;

a second display means having a plurality of food items from different food categories constituting arrays of well-balanced meals to be utilized in conjunction with said primary food items; and means connected to said first display means for selecting a particular array of food items in conjunction with a particular food entree.

* * * * *